US005272288A

United States Patent [19]

Kameli

[11] Patent Number: 5,272,288

[45] Date of Patent: Dec. 21, 1993

[54] ELEVATOR TRAFFIC PREDICTIONS USING HISTORICAL DATA CHECKED FOR CERTAINTY

[75] Inventor: Nader Kameli, New Britian, Conn.

[73] Assignee: Otis Elevator Company, Farmington, Conn.

[21] Appl. No.: 580,888

[22] Filed: Sep. 11, 1990

[51] Int. Cl.[5] ..... B66B 1/18

[52] U.S. Cl. ..... 187/127; 187/101; 187/125; 187/131; 187/133

[58] Field of Search ..... 187/127, 121, 124, 100, 187/132, 101, 125, 131, 133

[56] References Cited

U.S. PATENT DOCUMENTS

| | | | |
|---|---|---|---|
| 3,561,571 | 2/1971 | Gingrich | 187/127 |
| 4,044,860 | 8/1977 | Kaneko et al. | 187/132 |
| 4,330,836 | 5/1982 | Donofrio et al. | 564/567 |
| 4,363,381 | 12/1982 | Bittar | 187/29 R |
| 4,562,530 | 12/1985 | Umeda et al. | 187/100 |
| 4,672,531 | 6/1987 | Uetani | 187/124 |
| 4,802,557 | 2/1989 | Umeda et al. | 107/121 |
| 4,815,568 | 3/1989 | Bittar | 187/127 |
| 4,846,311 | 7/1989 | Thangavelu | 187/125 |
| 4,878,562 | 11/1989 | Schroder | 187/127 |
| 4,991,694 | 2/1991 | Friedli | 187/127 |
| 5,022,497 | 6/1991 | Thanagavelu | 187/124 |

*Primary Examiner*—Jeffre A. Gaffin
*Attorney, Agent, or Firm*—Breffni X. Baggot

[57] ABSTRACT

An elevator system (FIG. 1) employing a microprocessor-based group controller (FIG. 2) communicating with elevator cars (3,4, . . . ) to derive relative prediction values to be used in a scheme of ultimately assigning, e.g., cars to hall calls at a plurality of floors in the building, using appropriate dispatching strategies based on predicted traffic conditions. In the algorithm of the invention (FIG. 3) the building's inhabitants' behavior based on weekly events, daily events and real time events is predicted, with the events being used to derive relative prediction values based on the weighted summation of the real, daily and weekly values of the events. Weekly events are considered to be those that happened over a past number of weeks (e.g. 10 weeks) on the same day of the week; while daily events are those that happened over the past few days (e.g. 5 days). Real time events are those which are effectively currently happening, with the time frame of reference being sufficiently short to produce data which effectively can be considered "real time" data, typically covering only a matter of some minutes (e.g. 4 minutes) or even less. In determining what events recorded in the daily and weekly historic data bases are to be used in deriving the predicted relative values, the degree of the certainty of the data is evaluated using two threshold considerations, and historic factors based on data which fails to have the requisite certainty is not used in the predictions.

6 Claims, 3 Drawing Sheets

GROUP
CTRLR 17
22
15
16
CAR
CTRLR
OP/MO
PPT
25
27
29
26
28
30
7
8
5
6
CAB
CTRLR
35
36
CAB
3
4
SPT
13
14
33
34
23
24
18
19
20
12
11
LOB
PNL
21
1
2
9
10
31
32
HOISTWAY
"A"
HOISTWAY
"F"

ELEVATOR TRAFFIC PREDICTIONS USING HISTORICAL DATA CHECKED FOR CERTAINTY

REFERENCE TO RELATED APPLICATIONS

This application relates to some of the same subject matter as the co-pending applications listed below, owned by the assignee hereof, the disclosures of which are incorporated herein by reference:

Ser. No. 07/508,312 of the inventor hereof entitled "Elevator Dynamic Channeling Dispatching for Up-Peak Period" filed on Apr. 12, 1990;

Ser. No. 07/508,313 of the inventor hereof entitled "Elevator Dynamic Channeling Dispatching Optimized Based on Car Capacity" filed on Apr. 12, 1990;

Ser. No. 07/508,318 of the inventor hereof entitled "Elevator Dynamic Channeling Dispatching Optimized Based on Population Density of the Channel" filed on Apr. 12, 1990;

Ser. No. 07/580,901 of the inventor hereof entitled "Elevator Traffic 'Filter' Separating Out Significant Traffic Density" filed on even date herewith, now U.S. Pat. No. 5,024,296;

Ser. No. 07/580,905 of the inventor hereof entitled "Prediction Correction for Traffic Shifts Based in Part on Population Density" filed on even date herewith; and Ser. No. 07/580,887 of the inventor hereof entitled "Floor Population Detection for an Elevator System" filed on even date herewith; as well as Ser. No. 07/487,574 of Kandasamy Thangavelu entitled "'Artificial Intelligence' Based Learning System Predicting 'Peak-Period' Times For Elevator Dispatching" filed on Mar. 2, 1990; which is a continuation-in-part of Ser. No. 07/318,295 filed Mar. 3, 1989 entitled "'Artificial Intelligence' Based Crowd Sensing System For Elevator Car Assignment," which incorporated by reference its companion application Ser. No. 07/318,307 of Kandasamy Thangavelu, entitled "Relative System Response Elevator Dispatcher System Using 'Artificial Intelligence' to Vary Bonuses and penalties," likewise filed on Mar. 3, 1989, which '295 application is in turn a continuation-in-part of Ser. No. 07/209,744 entitled "Queue Based Elevator Dispatching System Using Peak Period Traffic Prediction" filed Jun. 21, 1988, now U.S. Pat. No. 4,838,384 issued Jun. 13, 1989, which incorporated by reference the disclosure of its companion application entitled "Optimized 'Up-Peak' Elevator Channeling System With Predicted Traffic Volume Equalized Sector Assignments" of Kandasamy Thangavelu, likewise filed Jun. 21, 1988, now U.S. Pat. No. 4,846,311 issued Jul. 11, 1989; as well as Ser. No. 07/318,295 of Kandasamy Thangavelu entitled "'Artificial Intelligence' Based Crowd Sensing System For Elevator Car Assignment" filed on Mar. 3, 1989; and Ser. No. 07/487,574 of Kandasamy Thangavelu entitled "'Artificial Intelligence' Based Learning System Predicting 'Peak-Period' Times For Elevator Dispatching" filed on Mar. 2, 1990.

TECHNICAL FIELD

The present invention relates to elevator systems and more particularly to predicting future conditions for the system based on past and real time events as a guide to, for example, dispatching cars and assigning the cars to calls during the operation of the system. More particularly, the present invention relates to combining three weighted factors-real time, daily and weekly data or predictions, the latter two being based on past events recorded in a historic data base for the elevator system. Additionally, the present invention relates to pre-evaluating the past or historic data to check for its "certainty" by comparing the data to various threshold considerations before the data is allowed to be used in making the predictions.

BACKGROUND ART

It is a fact that human beings are creatures of habit. They live a cyclic life in which events are "programmed" to happen at a certain time and in a particular sequence.

Using this basic assumption, the present invention provides a particular method of "humanizing" elevator systems. Since elevators are placed in buildings occupied by people, and people are said to have cyclic life, the present invention provides a way to better serve people occupying a building.

There are two basic factors used in the decision process of the system of the present invention:

I. People live a cyclic life.

When one wakes up in the morning, one usually does so at a predetermined time, every day of the year. After waking up, one follows a sequence of events, such as, taking a shower, eating breakfast, getting into the car, driving the same path to work, going to work, etc. Since people more or less "program" their lives (individually or with the help of the force of society), they tend to do this sequence at a particular time of day, plus or minus (±) a few minutes in a cyclic fashion.

In the particular situation of an elevator system, "cycle" could have two definitions:

I-A) Events that happen daily.

These events are ones that people do every day of the week, with the expectation that they will continue to do so in the future under ordinary circumstances. These events are, e.g., waking up in the morning, eating lunch, driving to work, etc.

I-B) Events that happen weekly.

These events have the same requirements as the daily events, with the only difference being that they only happen weekly. Examples of weekly events are, e.g., a group status meeting every Monday morning, getting a paycheck every Friday, watching a program on TV that airs every Tuesday, etc.

II. People are influenced by societal events.

One's societal activities may be functionally categorized as:

II-A) Functions that one does individually.

These are functions that people need or must do that require their sole participation. In a building, examples of such functions are going to another floor to have a question answered by the personnel department, visiting a friend working on a different floor, walking a visitor down to the lobby, etc.

II-B) Functions that are done in groups.

These functions also can be divided into two different categories:

(II-B-a) Functions that need participation of a group.

This group of functions describes the activities in the building that are done by a group of employees at the same time. Examples of these are project meetings, progress report meetings, product demonstrations, etc.

In these activities the presence of a group of people is required at a particular time and at a particular place.

(II-B-b) Functions that are done in a group of people individually.

These functions are performed by people as individual actions but due to circumstances may be observed as group activities. Examples of such activities are going to lunch, coming to work, leaving work to go home etc.

DISCLOSURE OF INVENTION

Using the above observations the present invention provides an algorithm that predicts the activities of a building's inhabitants and makes the predictions available to the elevator system for use in making the elevators more available to people at the time and place they need them, thereby enhancing elevator service time.

Although there have been previously described elevator systems which include predictions based on real time and historic, i.e., past, data, and which have represented substantial advancements in the art, none, it is believed, have been as comprehensive and as complete as the present invention and in particular have not separately evaluated and used the past data both from the perspective of the past few days as well as the past number of weeks, or used the data "certainty" checking techniques of the present invention.

For an example of a previous, related disclosure, note U.S. Pat. No. 4,846,311 of Kandasamy Thangavelu referred to above, which has been incorporated herein by reference and is owned by the assignee hereof.

The present invention thus originated from the need to improve elevator service time by more appropriately dispatching cars in the system to handle the traffic needs of the system based on making accurate prediction of the future needs of the system.

In the algorithm of the invention the building's inhabitant's behavior based on weekly events, daily events and real time events is predicted. Weekly events are considered to be those that happened over a few past weeks on the same day of the week; while daily events are those that happened on the past few days. Real time events are those which are effectively currently happening, with the time frame of reference being sufficiently short to produce data which effectively can be considered "real time" data, typically covering only a matter of a few minutes or less.

Real time predictions have at least two distinct uses in the invention:

1) they are used to predict the development of a new behavior or episode, and 2) they are used as the sole means for predicting any shift in the building's behavior based on either ordinary or extraordinary circumstances.

Real time predictions are performed based on the accumulated knowledge gathered during the past few, relatively short, time intervals. The interval length is of variable or programmable duration, of the order of a relatively short period of time, sufficiently short (as noted above) to be considered in practical effect, "real time," for example, one (1) to four (4) minutes for the typical office elevator system.

The present invention has two primary aspects.

First, in making predictions based on real time and historic data, the invention combines for the historic data two different chronological factors or cycles, namely weekly cycles, covering the last number of at least a few weeks, as well as daily cycles, covering the last at least few days within the past week. These two historic factors preferably are combined in an additive way with the real time data to produce, not a predicted absolute or true value of the predicted event(s), but rather a predicted relative value to be used in a subsequent relative, possibly shifting process of an appropriate elevator car assignment scheme.

Second, to improve the reliability and hence the accuracy of the predictions, the invention uses data certainty evaluation resulting in the predictions being based only on data which is indicated as being reliable. It achieves this by using two levels of threshold evaluations.

Preferably it first initially evaluates each datum in the historic data base being used by comparing each one to a preset or predefined threshold value. If the datum does not, for example, exceed the threshold value, it is given no weight in a further evaluation, which then takes into account the corresponding datum for the other days in the historic data base, whether it is the daily or weekly data base.

In this further evaluation, if an insufficient number of the days have datum values that exceed the initial threshold value, than the prediction of the future value of that data is effectively not directly used in making the final prediction by preferably setting that historic prediction value (daily or weekly, as the case may be) to zero. In which case the final predicted value is based on only the real time data and the other historic factor, assuming that the latter passes the dual threshold considerations which the other had failed.

This data "certainly" technique assures that the predictions are based on only reliable historic data.

Additionally, the prediction values generated in the present invention are used for predicting the relevant elevator system events for the complete day all in one time frame. Because a substantial amount of data processing is then necessary, the data processing is preferably done late at night or very early in the next morning in order for the computer system to be preferably exclusively available to make the next day's predictions and store the values for use during the next day without interfering with the operation of the system.

Thus, the approaches of the invention result in better service for the elevator system that would otherwise have been achieved by providing improved prediction techniques for use in improving elevator system performance.

Part of the strategy of the present invention for its accurate predictions is to use linear exponential smoothing. It is noted that some of the general prediction or forecasting techniques of the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.6: "Linear Exponential Smoothing." An additional application of these principles to an elevator system are disclosed in the above-referenced '311 patent.

The invention may be practiced in a wide variety of elevator systems, utilizing known technology, in the light of the teachings of the invention, which are discussed above and below in some further detail.

Other features and advantages will be apparent from the specification and claims and from the accompanying drawings, which illustrate an exemplary embodiment of the invention.

BRIEF DESCRIPTION OF DRAWINGS

FIG. 1 is a simplified illustration, partially cut away, of one exemplary elevator system in which the present invention may be incorporated in connection with the group controller and the individual elevator car controllers; while

BEST MODE

Figures 1, 2:
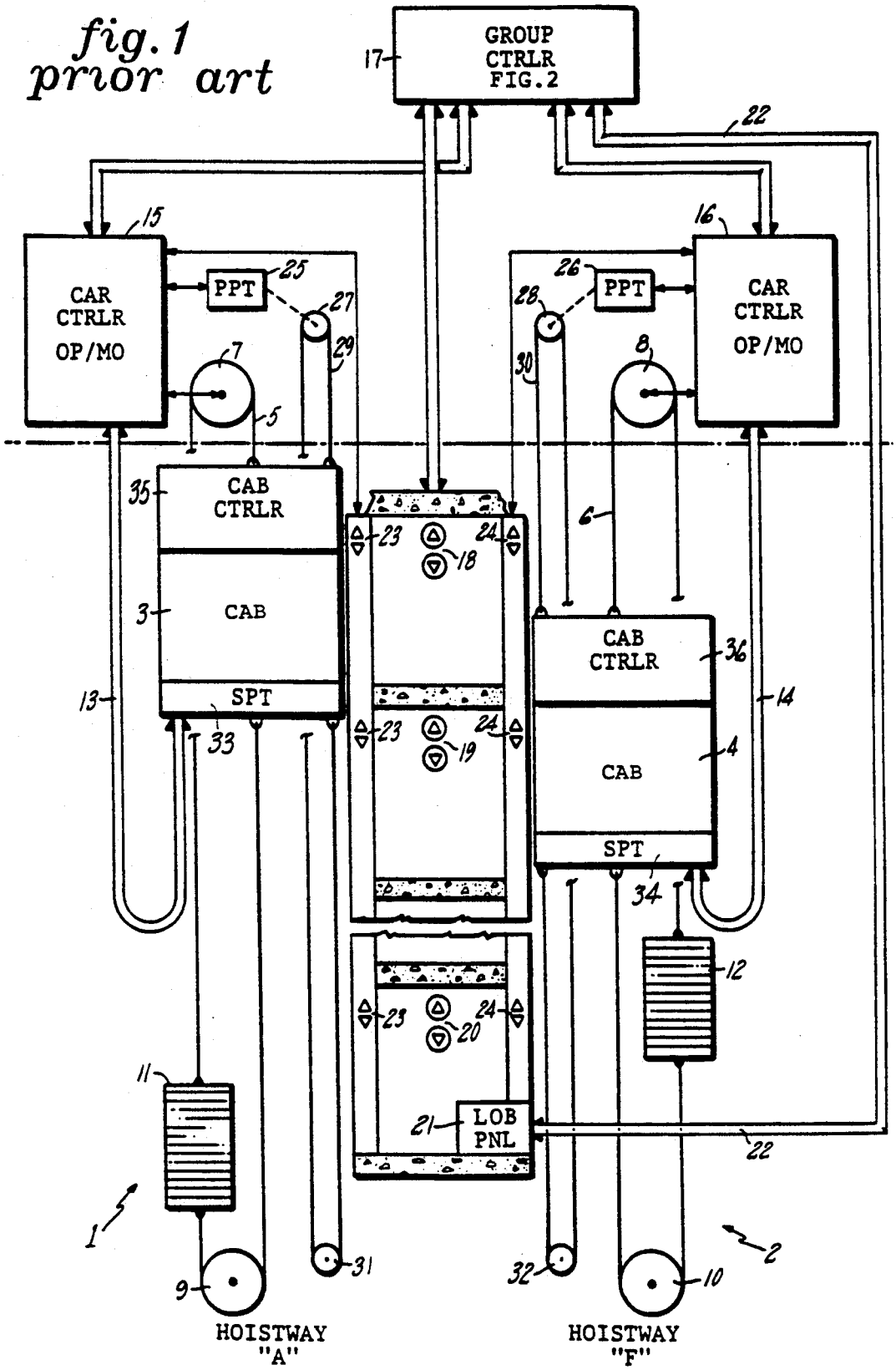
fig. 1 prior art
Figure 2:
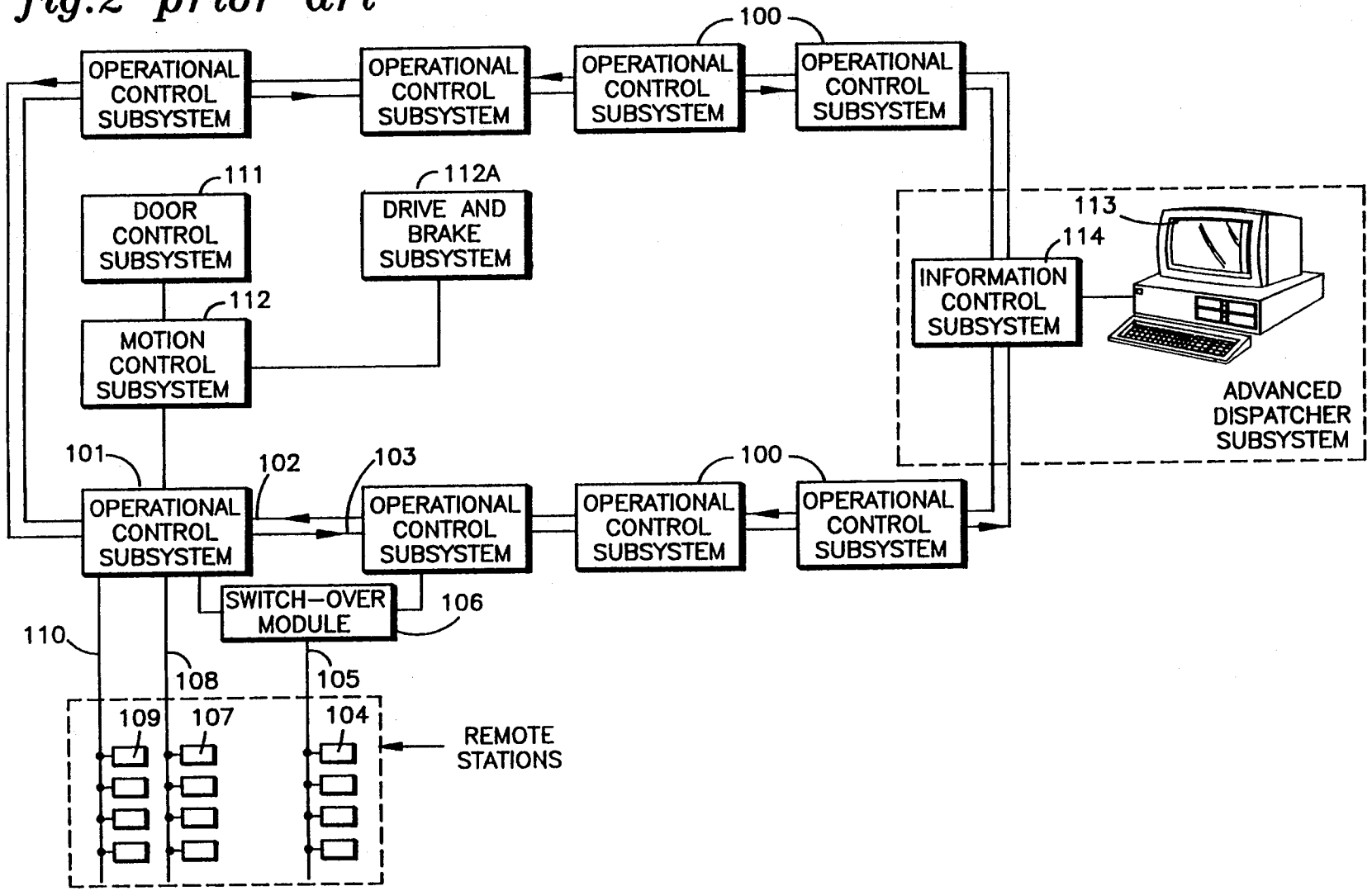
fig.2 prior art
FIG. 2 is a simplified, schematic block diagram of an, exemplary ring communication system for elevator group control, which alternatively be employed in connection with the elevator car elements of the system of FIG. 1, and in which the invention may be implemented in connection with the advanced dispatcher subsystem (ADSS) and the cars' individual operational control subsystems (OCSS) and their related subsystems.

Exemplary Elevator Application (FIG. 1)

For the purposes of detailing an exemplary application for the present invention, the disclosures of U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. Pat. No. 5,024,295 of Kandasamy Thangavelu entitled "Relative System Response Elevator Dispatcher System Using 'Artificial Intelligence' to Vary Bonuses and Penalties," as well as of the commonly owned U.S. Pat. No. 4,330,836 entitled "Elevator Cab Load Measuring System" of Donofrio and Games issued May 18, 1982, are incorporated herein by reference.

The preferred application for the present invention is in an elevator control system employing microprocessor-based group and car controllers using signal processing means, which through generated signals communicates with the cars of the elevator system to determine the conditions of the cars and responds to hall calls registered at a plurality of landings in the building serviced by the cars under the control of the group and car controllers, to provide assignments of the hall calls to the cars. An exemplary elevator system with an exemplary group controller and associated car controllers (in block diagram form) are illustrated in FIGS. 1 and 2, respectively, of the '381 patent and described in detail therein.

It is noted that FIG. 1 hereof is substantively identical to FIG. 1 of the '381 and '568 patents. For the sake of brevity the elements of FIG. 1 are merely outlined or generally described below, while any further, desired operational detail can be obtained from the '381 and the '568 patents, as well as others of assignee's prior patents. additionally, for further example, the invention could be implemented in connection with the advanced dispatcher subsystem (ADSS) and the operational control subsystems (OCSSs) and their related subsystems of the ring communication system of FIG. 2.

In FIG. 1 a plurality of exemplary hoistways, HOISTWAY "A" 1 and HOISTWAY "F" 2 are illustrated, the remainder not being shown for simplicity purposes. In each hoistway an elevator car or cab 3, 4 (etc.) is guided for vertical movement on rails (not shown). Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18–20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller 17 in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone andouter door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 which may provide serial, time-multiplexed communications with the car controller 15, 16, as well as direct, hard-wired communications with the car controller by means of the traveling cables 13 and 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefor, under conditions which are determined to be safe.

The makeup of micro-computer systems, such as may be used in the implementation of the car controllers 15, 16, the group controller 17, and the cab controllers 35, 36, can be selected from readily available components or families thereof, in accordance with known technology as described in various commercial and technical publications. The microcomputer for the group controller 17 typically will have appropriate input and output (I/O) channels, an appropriate address, data and control buss and sufficient random access memory (RAM) and appropriate read-only memory (ROM), as well as other associated circuitry, as is well known to those of skill in the art. The software structures for implementing the present invention, and the peripheral features which are disclosed herein, may be organized in a wide variety of fashions.

Exemplary Ring System (FIG. 2)

As a variant to the group controller elements of the system of FIG. 1, in certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed to separate microprocessors, one per car. These microprocessors, known as operational control subsystems (OCSS) 100, 101, are all connected together in a two-way ring communication (102, 103). Each OCSS 100, 101 has a number of other subsystems and signaling devices, etc., associated with it, as will be described more fully below, but basically only one such collection of subsystems and signaling devices 104-112A is illustrated for the OCSS 101 in FIG. 2 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. This load in turn is sent to the OCSS 101. DCSS 111 and MCSS 112 are micro-processors controlling door operation and car motion under the control of the OCSS 101, with the MCSS 112 working in conjunction with the drive & brake subsystem (DBSS) 112A.

The dispatching function is executed by the OCSS 100, 101, under the control Microcomputer of the advanced dispatcher subsystem ADSS 113, which communicates with the OCSSs 100, 101 via the information control subsystem (ICSS) 114. The car load measured may be converted into boarding and de-boarding passenger counts by the MCSS 112 and sent to the OCSS 101. The OCSS send this data to the ADSS 113 via ICSS 114.

As explained more fully below, the ADSS 113 through signal processing inter alia collects the passenger boarding and de-boarding counts at the various floors and the hall calls and car calls, so that, in accordance with its programming and using daily and weekly "historic" data bases, it can analyze the data and produce by prediction methodology a relative value, which is used to ultimately assign cars to particular floor locations or roles in a manner which improves the elevator system's performance. The ADSS 113 can also collect other data for use in making other predictions for other uses, if so desired.

For further background information reference is also had to the magazine article entitled "Intelligent Elevator Dispatching Systems" of Nader Kameli & Kandasamy Thangavelu (AI Expert, September 1989; pp. 32-37), the disclosure of which is also incorporated herein by reference.

Thus, owing to the computing capability of the "CPUs," the system can collect data on individual and group demands throughout the day to, inter alia, produce historical records of traffic demands for each day of the week in both daily and weekly data bases stored on the hard disk of the ADSS's microcomputer 113 on a time-interval-by-time-interval basis and compare the data to actual "real time" demand or otherwise use it in the manner detailed below to ultimately adjust the overall dispatching sequences in an accurate and certified way to achieve a prescribed level of system and individual car performance.

As generally discussed above, the present invention has two primary aspects:

(a) in making predictions based on real time and historic data, combining for the historic data two different chronological factors or cycles, namely weekly cycles, covering the last number of at least a few weeks, as well as daily cycles, covering the last at least few days within the past week, with the two historic factors preferably being combined in an additive way with the real time data to produce, not a predicted absolute or true value, but rather a predicted relative value to be used in a subsequent relative, possibly shifting process of an appropriate elevator car assignment scheme [e.g. a Relative System Response (RSR) scheme]; and/or (b) using data certainty evaluation which results in the predictions using only data which is indicated as being reliable.

Combining Weekly and Daily Data for "Historic" Part of Predictions

As to the first aspect of the invention, namely combining both weekly and daily data for the historic part of the prediction, which is ultimately to be used for dispatching elevator cars to desired floor locations or assigning them to desired roles (e.g. channeling), preferably four (4) parameters for the "up" direction and separately for the "down" directions are considered for each interval of time [e.g. every four (4) minutes] being considered, for a total of eight (8) parameters. Each set of four (4) parameters preferably includes for each floor and direction:

1. passenger boarding counts,
2. passenger de-boarding counts,
3. hall calls, and 4. car calls, for that floor. The actual data for the eight parameters, which is received from the various OCSSs 100, 101 of the system, are recorded in a "historic" data base. This historic data base can be recorded and maintained on "permanent" media, e.g. a hard disk in the microcomputer of the ADSS 113 or an associated optical disk, in an appropriate file format.

A daily "historic" data base is maintained for the desired number of days, for example, for the preceding last four "active" days, or, if for example, Saturday is an "active" day, for the preceding five "active" days, but for no more than the six (6) preceding days, as well as recording the actual events of the current day as it unfolds. Thus, assuming, for example, that the current day in process is Thursday, the data base would include data on the events for the preceding Wednesday, Tuesday, Monday, (possibly Saturday but not Sunday, assuming Sunday is inactive) and Friday of the preceding week. Upon the completion of the current "active" day, its data recorded for the actual events of the day is added to the data base and the oldest's day's data is deleted from the data base, or, alternatively, the current day's data is entered into the data base on a real time basis and the corresponding data of the oldest day's data deleted on a real time basis or deleted in block after the completion of the recording of the data for the current day.

In somewhat like fashion, a weekly "historic" data base of the real data on a per interval basis is maintained including a sufficient number of weeks' data for the past data to stabilize, with ten (10) weeks of data being exemplary. The weekly historic data is preferably maintained in separate files by the respective day of the week, that is one file would contain the data for the last ten Mondays, the next containing the data for the last ten Tuesdays, etc., with their being a total typically of five (Monday through Friday) or six (M-F and Saturday) weekly files.

As the oldest day's data from the daily historic data base is deleted, it is added to the weekly historic data base for that respective day. Thus, in essence, in the example above, the data for, for example, the preceding Thursday is added to the weekly data file for the Thursdays before (or as) it is deleted from the daily data base, with the oldest Thursday's data of ten weeks ago then being deleted from the weekly data base file for the Thursdays.

The data from these daily and weekly historic data base files is then used and effectively combined in the manner further detailed below to derive the value of the final prediction based on the parameter and time interval being considered in accordance with the following formula:

$$P(\text{total})=\alpha P(rt)+\beta P(d)+\delta P(w)$$

where

P(total) is the complete combined prediction value,
P(rt) is the prediction factor based on real time data,
P(d) is the prediction factor based on daily data,
P(w) is the prediction factor based on weekly data, while
$\alpha$ is a factor representing the weight to be given to the real time prediction,
$\beta$ is a factor representing the weight to be given to the daily prediction and
$\delta$ is a factor representing the weight to be given to the weekly prediction, in which $$\alpha+\beta+\delta=1, \text{ with preferably } \alpha>\beta\geqq\delta.$$

Exemplary values for the weighing factors are $\alpha=0.4$ and $\beta=\delta=0.3$ Data "Certainty" Evaluations As to the second aspect of the invention, namely, evaluating the historic data to insure its "certainty" or reliability, two threshold considerations are made before the historic data (whether daily or weekly) for the parameter is allowed to be directly used in the derivation of the final or total predicted value for that time interval.

First, the recorded historic value for each day of the historic data base (either daily or weekly) for the parameter for the time interval involved is compared to a predefined threshold or minimum value, and, depending on whether or not the value exceeds the threshold, an interim value of either "1" or "0" is associated with that datum. Thus, if, for example, the recorded historic value does not exceed that threshold value, an interim value for the datum of the historic factor being considered is set to zero for the parameter being considered; otherwise it is set to one (1).

Then, after each datum has been compared to the minimum threshold value and assigned a "1" (exceeds threshold) or a "0" (≦threshold), the interim values for each of the days of the data base is added up to form the "certainty" factor for that interval. This "certainty" factor is then compared to a separate, certainty factor threshold value. If the total interim value does not exceed the certainty factor threshold value, the predicted historic value is then set to zero [P(d) or P(w)=0, depending on which is being evaluated]. Thus, that set of datum values (daily or weekly or both) is not directly used in deriving the final predicted value [P(total)], and its lack of "certainty" or reliability causes the final or total predicted value to be lessened.

To further illustrate this "certainty" approach of the invention, exemplary sets of datum of the historic daily data base is set out below for passenger de-boarding counts in two exemplary intervals:

| Past Days | Interval #200 | Interval #201 |
|---|---|---|
| Wednesday | 3 | 7 |
| Tuesday | 6 | 7 |
| Monday | 7 | 7 |
| Saturday | 8 | 7 |
| Friday | 10 | 9 |
| Thursday | 20 | 19 |

For an initial threshold datum value of, for example, "6", it can be seen that the datum for Interval #200 for both Wednesday and Tuesday is below or equal to the initial threshold value, and, accordingly, the datum for these two days would each have a zero associated with it, while the other days' data for that interval would each have interim values of "1", since they each exceed that threshold. The total certainty factor value for that interval would then be "4" (4 "above-threshold-days"×1+2 "not-above-threshold-days"×0). For a preset certainty factor threshold value of "4", this would result in the daily prediction value for interval #200 for this parameter (de-boarding counts) to be set to zero [P(d)=0], since the total certainty value did not exceed the certainty factor threshold value.

On the other hand, if the preset datum threshold value had been, for further example, "5", the data for interval #200 would pass the certainty factor evaluation, and all of the data for that interval would be used (using, for example, linear exponential smoothing) for the daily prediction value. In either event, whether the datum threshold value was "5" or "6", the data for Interval #201 would pass the certainty factor evaluation, since each of its individual day's datum exceeds the initial value of "6", and it would thus have a "certainty" factor value of "6".

An exemplary certainty factor threshold value for a daily data base having five active days in it is "4", while "7" is an exemplary certainty factor threshold value for a weekly data base prediction having ten weeks of data in it, namely ten days for each elevator active day of the week. Of course, the particular certainty factor threshold value used is subject to significant variation, but it should include at least a majority number (half the number in the set). Thus, for a five day data base the certainty factor threshold value should be at least "3", while for a ten day weekly daily data base it should be at least "5". The certainty factors are calculated for each interval for each parameter for each historic data base.

Prediction Algorithm

The basic predicting mode used for each individual parameter in the complete, exemplary prediction algorithm of the present invention preferably is linear exponential smoothing. (See, for example, Section 3.6 of the Makridakis & Wheelwright text cited above.)

The essence of linear exponential smoothing based on Brown's one-parameter linear exponential smoothing of the Makridakis & Wheelwright text (see page 61 et seq.), is represented by the following equation:

$$P(t+m)=2S'(t)-S''(t)+AM/(1-A)\{S'(t)-S''(t)\}$$

where $S'(t)=AX(t)+(1-A)S'(t-1)$ $S'(0)=X(0)$ $S''(t)=AS'(t)+(1-A)S''(t-1)$ $S''(0)=X(0)$ and P(t+m) is the prediction for "m" intervals from now, S'(t) is a single smoothing value, S''(t) is a double smoothing value, A is a weighing factor and is a pure number, for example, two-tenths (0.2), and m is the number of intervals ahead to be predicted, which could be, for example, two (2) intervals, with an exemplary interval being a one (1) minute time period.

This method is used for predicting the various parameters individually. As noted above, the final prediction algorithm is based on the following formulas:

$$P(total)=\alpha P(rt)+\beta P(d)+\delta P(w)$$

and $$\alpha+\beta+\delta=1, \text{ with preferably } \alpha>\beta\geqq\delta.$$

along with the following conditions if C(pd)>Threshold(pd), then P(d)=P(d)

(else)

if C(pd)≦Threshold(pd), then P(d)=0; and if C(pw)>Threshold(pw), then P(w)=P(w)

if C(pw)≦Threshold(pw), then P(w)=0 where as described hereinbefore

P(total) is the complete combined prediction,

P(rt) is the prediction factor based on real time data,

P(d) is the prediction factor based on daily data,

P(w) is the prediction factor based on weekly data, $\alpha$ is a factor representing the weight to be given to the real time prediction, $\beta$ is a factor representing the weight to be given to the daily prediction, $\delta$ is a factor representing the weight to be given to the weekly prediction, and where C(pd) is the certainty factor of daily prediction, and C(pw) is the certainty factor of weekly prediction.

Of course, if so desired, the two threshold considerations for the datum and the certainty factor could be altered so that the conditions were satisfied if there were at least equality of the values with the threshold values, rather than having to exceed the threshold values. Such a change can be adjusted for, if needed, by varying the threshold values themselves. It is merely desirable to have some specific limit set so that the computer based comparison can test for a true ("1") or a false ("0") value, allowing for, for example, an "If . . . then . . . else" sort of logic statement.

As stated above, the final complete prediction for the next interval is a combination of the real time, daily and weekly predictions. However, these factors are preferably not treated equally.

Thus, real time prediction is preferably always used with a greater certainty factor, because it is postulated that real time data is more reliable than the other two (daily and weekly), since its time has already started. Hence, daily and weekly predictions have lower certainty factors than the real time predictions.

These latter two (daily and weekly) could be equal, meaning that the weekly and daily events are both equally present and detected in the building but typically would be less than the real time prediction. They could also be not equal.

If they are unequal, then the certainty factor associated with, for example, the daily prediction preferably will have a higher value than the weekly certainty factor. This is because weekly predictions are made based on a data that is always older than the date used in the daily prediction. It is thus postulated that, if there is a dispute between the daily and weekly predictions, the daily prediction has a higher probability of being correct than does the weekly prediction.

As generally referred to above, the certainty factor for the daily prediction is generated by accumulating the number of flags set for one specific interval during, for example, the past six active (6) days where Saturday is active. For example, as noted in the table above, should the certainty factor for the two hundredth interval (interval #200) of the day report a value of four (4), it means that during the past six active (6) days, the two hundredth interval was part of a pattern (datum value in excess of initial threshold datum value) four (4) times out of six (6). This number is then compared against the pre-specified daily pattern that happens at least, for example, five (5) days out of six (6) days in the daily prediction. If the certainty factor falls below that threshold, it means that one can not really confident about the possibility of the repeating occurrence of this pattern as of yet, and, therefore, it is preferably ignored for now.

The same reasoning and methodology is used for the weekly prediction certainty factor. The difference is that, since the number of weeks considered may be, e.g., ten (10), then the threshold value typically would usually be higher than the threshold value used for the daily predictions. In any case it should be noted that the two threshold values do not have any relation to one another, and they are set and used individually.

Once the three predictions (real, daily and weekly) are made, they are combined according to their weights in the final prediction. As previously noted, there are three weighing factors in the system, viz.

$\alpha$ the weight of the real time prediction, $\beta$ the weight of the daily prediction and $\delta$ the weight of the weekly prediction.

These weights are coordinated so that their summation is unity, i.e., $$\alpha+\beta+\delta=1$$

Thus, should the three predictions values each be the same, the final prediction value will be the same number as well.

Figure 3:
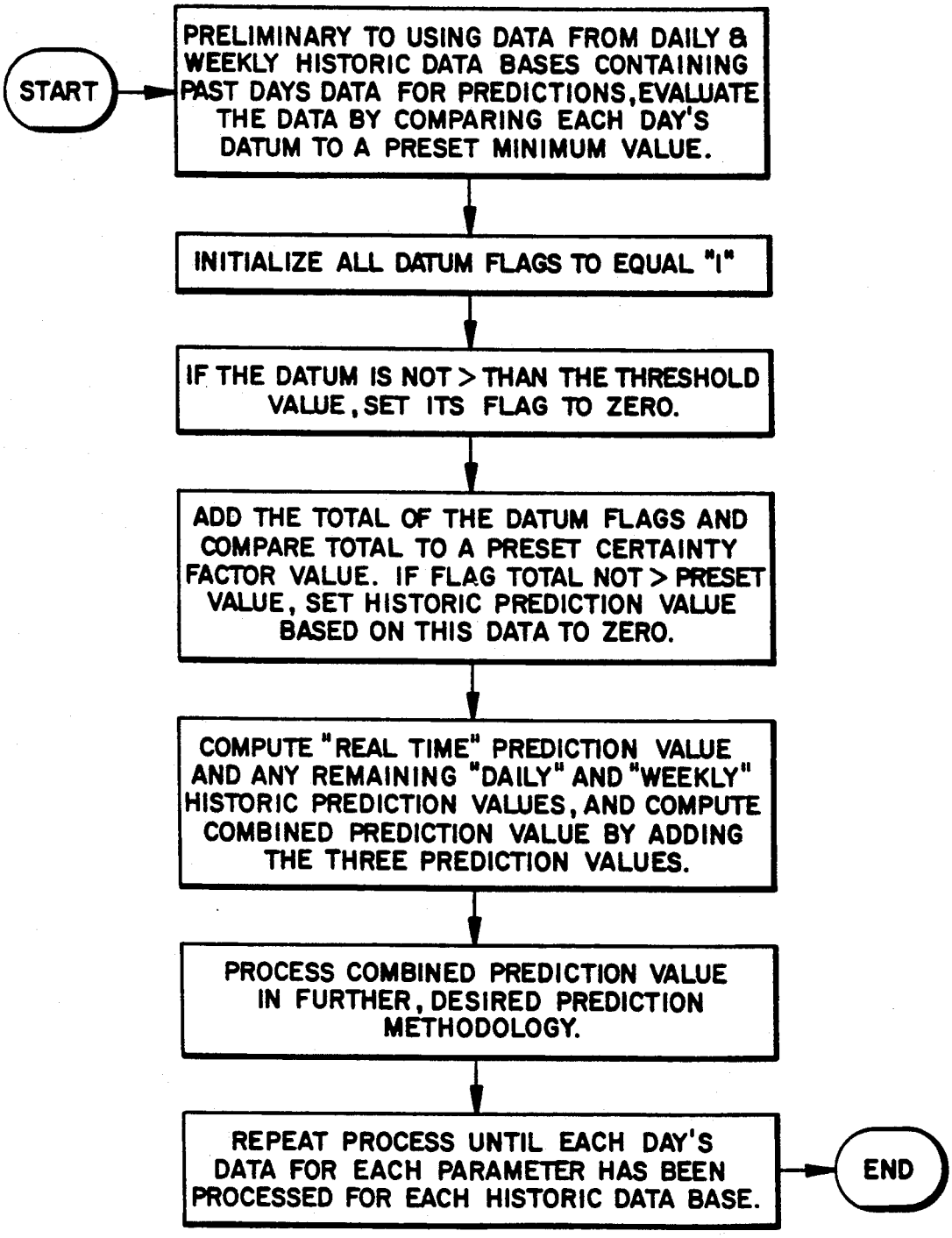
FIG. 3 illustrates as simplified, summarized, flow chart diagram of the exemplary methodology of the invention used for deriving more accurate prediction values, combining both daily and weekly historic prediction factors based on data which has been evaluated for its "certainty," which prediction values can then be used in conjunction with an appropriate car assignment scheme to improve elevator system performance.

Exemplary Methodology for Deriving Certified Prediction Values (FIG. 3)

The exemplary methodology for preliminarily certifying the data to be used for making predictions and then providing a combined prediction value based on two different chronological historic data bases, namely "daily" and "weekly", is summarized in flow chart form in FIG. 3, the steps of which have been covered in detail above.

As summarized in FIG. 3, the data in the historic data bases, both daily and weekly, are preferably first certified by comparing each day's parameter datum for each time interval to a preset threshold or minimum value for that parameter. After initializing all of the datum flags to "1", each datum that failed to exceed the threshold value has its flag changed to "zero".

The total number of the datum flags of all of the days' datum flags for that interval is then added up, and that computed value is compared to the preset certainty factor threshold value. If the computed flag total is not greater than the preset value, the historic prediction value for that parameter, which otherwise would have been computed based on that data, is instead set to zero.

The "real time" prediction and any remaining historic predictions (daily and/or weekly), i.e. any prediction which had not had its historic data value set to zero because of the relative "uncertainty" of the data, is then computed from the related sets of historic data. The combined prediction value is then computed based on the linear, additive formula detailed above using the weighted computed "real time" prediction value and the weighted computed or set daily and weekly prediction values.

It should be noted that the "final" or combined prediction value, based on the weighted values of the real, daily and weekly predictions, generally should not be considered an absolute value but rather a relative value, which is to then be used in an appropriate car assignment scheme, such as, for example, that disclosed in assignee's U.S. application Ser. No. 07/318,307 filed Mar. 3, 1989 entitled "Relative System Response Elevator Dispatcher System Using 'Artificial Intelligence' Vary Bonuses and Penalties" by Kandasamy Thangavelu.

Thus, the combined prediction value is then further processed using any desired prediction methodology, such as for example, a Relative System Response (RSR) scheme.

The preliminary certification and computed combined prediction value process summarized in FIG. 3 is then cyclically repeated until each day's data for each interval for each parameter has been processed for both the daily and the weekly historic data bases.

Preferably, the prediction values generated in the present invention are used for predicting the relevant elevator system events for the complete following day all in one time frame. Therefore, the "real time" data is obviously simply the most recent data (e.g., earlier "today") used in the combined calculation. Because a substantial amount of data processing is necessary, the data processing is preferably done late at night (about e.g. 11:00 PM) or very early in the next morning (about e.g. 1:30 AM) in order for the computer system to be preferably exclusively available to make the next day's predictions and store the values for use during the next day without interfering with the car operations of the system. Thus, the prediction values are preferably derived during an inactive period of the day, i.e. inactive for the use of the elevator cars of the elevator system, typically which would be within the time frame of 8 PM through 6 AM.

Although this invention has been shown and described with respect to at least one detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. A method of dispatching a plurality of elevator cars serving a building, comprising:

for each car, during each one of a large number of time intervals in each business day, providing respective traffic signals having values indicative of counts related to passenger traffic for each floor and each direction in which passengers can travel to or from each floor, said traffic signals including boarding signals indicative of the number of passengers boarding said car, deboarding signals indicative of the number of passengers deboarding said car, hall calls registered, and car calls registered;

storing each of said traffic signals for a number of days;

providing a threshold signal having a value indicative of a certainty factor threshold value;

providing, for each kind of said traffic signals, a minimum value signal having a value indicative of a minimum count for the related kind of traffic signal;

for each of said time intervals, comparing the count indicated by each traffic signal in a group of traffic signals provided in diverse days with the count indicated by a corresponding one of said minimum value signals and providing a certainty signal having a value indicative of the number of said signals in said group for each interval indicating a count in excess of the count indicated by the corresponding one of said minimum value signals;

comparing the value indicated by each of said certainty signals with the value indicated by said threshold signal; and dispatching elevator cars to provide service in said building in response to a process which utilizes the traffic signals, in each of said groups for which the value indicated by the related certainty signal exceeds the value indicated by said threshold signal, to predict the level of the kinds of traffic counts indicated by said groups.

2. A method of dispatching a plurality of elevator cars serving a building, comprising:

for each car, during each one of a large number of time intervals in each business day, providing respective traffic signals having values indicative of counts related to passenger traffic for each floor and each direction in which passengers can travel to or from each floor, said traffic signals including boarding signals indicative of the number of passengers boarding said car, deboarding signals indicative of the number of passengers deboarding said car, hall calls registered, and car calls registered;

storing each of said traffic signals for a predetermined number of days including a plurality of weeks;

providing a daily threshold signal having a value indicative of a daily certainty factor threshold value;

providing a weekly threshold signal having a value indicative of a weekly certainty factor threshold value;

providing, for each kind of said traffic signals, a minimum value signal having a value indicative of a minimum count for the related kind of traffic signal;

for each of said time intervals, comparing the count indicated by each of said traffic signals in a daily group thereof provided during the last several days with the count indicated by the corresponding one of said minimum value signals and providing a daily certainty signal having a value indicative of the number of said signals in each daily group for each interval indicating a count in excess of the count indicated by the corresponding one of said minimum value signals;

comparing the value indicated by each of said daily certainty signals with the value indicated by said daily threshold signal;

for each of said time intervals, comparing the count indicated by each of said traffic signals in a weekly group thereof provided during the same day of the week for the last several weeks with the count indicated by the corresponding one of said minimum value signals and providing a weekly certainty signal having a value indicative of the number of said signals in each weekly group for each interval indicating a count in excess of the count indicated by the corresponding one of said minimum value signals;

comparing the value indicated by each of said weekly certainty signals with the value indicated by said weekly threshold signal; and dispatching elevator cars to provide service in said building in response to a process which utilizes the traffic signals, in each of said daily groups for which the value indicated by the related daily certainty signal exceeds the value indicated by said daily threshold signal and in each of said weekly groups for which the value indicated by the related weekly certainty signal exceeds the value indicated by said weekly threshold signal, to predict the level of the kinds of traffic counts indicated by said groups.

3. A method according to claim 2 including:

changing the value indicated by all of the traffic signals in said daily group to zero if the value indicated by the related daily certainty signal is not greater than the value indicated by said daily threshold signal;

changing the value indicated by all of the traffic signals in said weekly group to zero if the value indicated by the related weekly certainty signal is not greater than the value indicated by said weekly threshold signal;

dispatching elevator cars to provide service in said building in response to a process which utilizes the traffic signals in each of said daily groups and in each of said weekly groups for which the values are not all zero.

4. A method according to claim 2 including:

providing, for each of said time periods for each of said traffic counts for each floor and each direction a daily predicted traffic signal based on the related ones of said daily groups for which the value indicated by said daily certainty signal exceeds the value indicated by said daily threshold signal;

a weekly predicted traffic signal based on the related ones of said weekly groups for which the value indicated by said weekly certainty signal exceeds the value indicated by said weekly threshold signal; and a total predicted traffic signal having a value indicative of a weighted summation of the most recently provided one of said traffic signals, said daily predicted traffic signal, and said weekly predicted traffic signal; and dispatching elevators in response to a process which utilizes said total predicted traffic signals.

5. A method of dispatching a plurality of elevator cars serving a building, comprising:

for each car, during each one of a large number of time intervals in each business day, providing respective traffic signals having values indicative of four kinds of traffic counts related to passenger traffic for each floor and each direction in which passengers can travel to or from each floor, said traffic signals including boarding signals indicative of the number of passengers boarding said car, deboarding signals indicative of the number of passengers deboarding said car, hall calls registered, and car call registered;

storing each of said traffic signals for a predetermined number of days including a plurality of weeks;

providing, for each of said time periods for each of said four kinds of traffic counts for each floor and each direction a daily predicted traffic signal based on a daily group thereof provided during the last several days;

a weekly predicted traffic signal based on a weekly group thereof provided during the same day of the week for the last several weeks; and a total predicted traffic signal having a value indicative of a weighted summation of the most recently provided one of said signals, said daily predicted traffic signal, and said weekly predicted traffic signal; and dispatching elevators in response to a process which utilizes said total predicted traffic signals.

6. A method according to claim 5 wherein:

the weighting of said daily and weekly values are equal to each other and less than that of said most recently provided values.

* * * * *